US008210350B1

(12) United States Patent
Marseglia

(10) Patent No.: US 8,210,350 B1
(45) Date of Patent: Jul. 3, 2012

(54) STORAGE AND DISPENSER FOR BABY BOTTLE NIPPLES AND COLLAR

(76) Inventor: Eric Marseglia, Hermosa Beach, CA (US)

( * ) Notice: Subject to any disclaimer, the term of this patent is extended or adjusted under 35 U.S.C. 154(b) by 0 days.

(21) Appl. No.: 13/411,532

(22) Filed: Mar. 3, 2012

(51) Int. Cl.
*B65D 85/00* (2006.01)

(52) U.S. Cl. ..... 206/445; 206/776; 206/499; 220/524

(58) Field of Classification Search ..... 206/445, 206/499, 769, 775, 776, 781, 303; 220/503, 220/524, 526, 529
See application file for complete search history.

(56) References Cited

U.S. PATENT DOCUMENTS

| | | | | |
|---|---|---|---|---|
| 3,961,719 | A * | 6/1976 | Pierlot et al. | 215/277 |
| 2004/0178161 | A1* | 9/2004 | Galustyan | 215/11.1 |
| 2006/0231429 | A1* | 10/2006 | Snell | 206/223 |
| 2006/0266667 | A1* | 11/2006 | Mendenhall et al. | 206/427 |

* cited by examiner

*Primary Examiner* — Jacob K Ackun

(57) ABSTRACT

A portable compact baby bottle nipple and collar storage and dispenser case includes a cylindrical tubular member, a top cap, a bottom cap and a nipple-shaped insert. The bottom cap is tethered to a retaining ring for preventing separation of the bottom cap and the cylindrical tubular member. The nipple-shaped insert separates any clean nipples and collars held by the dispenser from any dirty nipples and collars held by the dispenser.

10 Claims, 4 Drawing Sheets

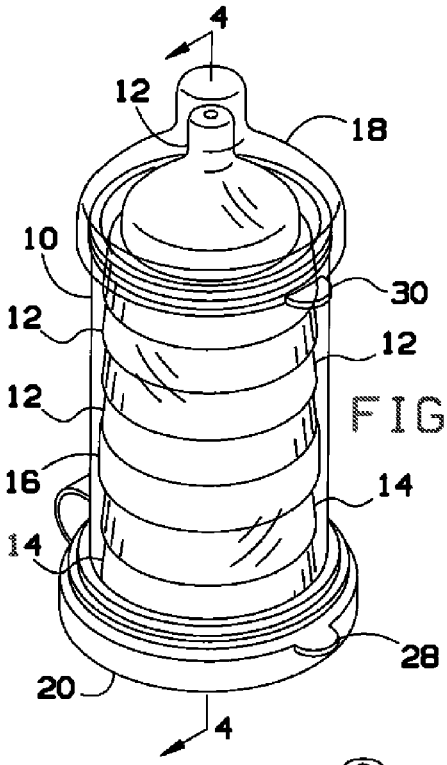
FIG. 1
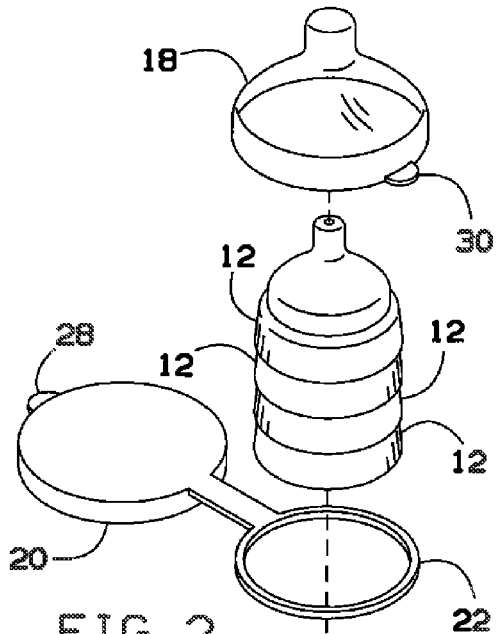
FIG. 2
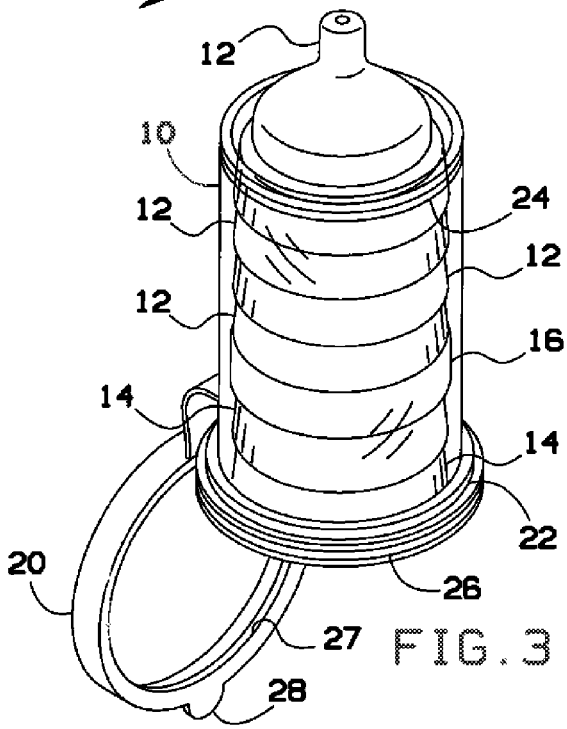
FIG. 3
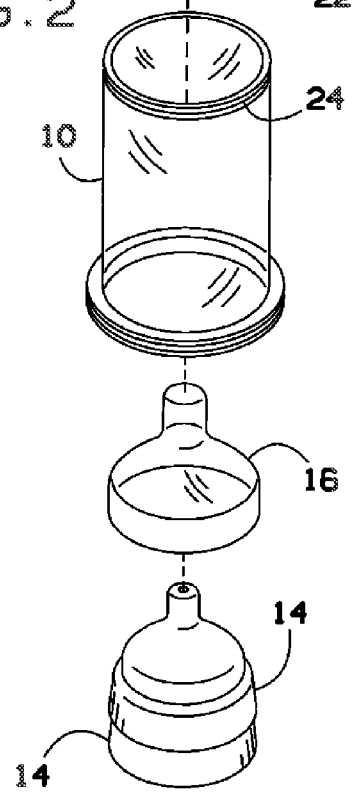

STORAGE AND DISPENSER FOR BABY BOTTLE NIPPLES AND COLLAR

BACKGROUND OF THE INVENTION

The present invention relates generally to the feeding of infants or toddlers but may also be relevant to other persons or animals requiring liquid feeding by bottle. More particularly, the invention concerns enabling parents to continue providing clean feeding equipment to their infants or toddlers over the course of a day and while away from a home or other convenient location for washing.

Baby bottle nipples and collars need to be washed and sanitized before each use. Cleaning is tough while on the go away from the home and carrying multiple nipples and collars would normally take up too much space.

Some companies have provided disposable inserts for lining feeding bottles. These overcome the matter of having sterile bottles but do not solve the issue of unsanitary, used nipples and collars.

One feeding bottle system includes a threadably sealable opening in its bottom end intended to receive a pacifier. While it may be possible to carry a nipple rather than a pacifier, a person still needs to carry around multiple bottles and nipples for feedings throughout the day or has to clean one after each use.

If a person were to go out for the day they would need approximately a clean bottle and nipple for feedings every 1½ to 2 hours thr their infant or toddler. In a 12 hour day approximately six bottles, six nipples and collars would be needed. As pointed out, carrying this many bottles, nipples and collars is cumbersome.

SUMMARY OF THE INVENTION

The present invention allows up to seven feedings with clean nipples and collars and only two containers need to be carried—a bottle with nipples and collars and the 7½" dispenser and storage case. The compact baby bottle nipple and collar storage and dispenser provides up to 6 clean nipples and collars for feeding and a place to store used nipple and collars without the need of separate bottles for each feeding. Therefore, the number of bottles one needs to carry around during a busy day is reduced. No other known device functions as a compact nipple and collar dispenser and storage ease for parents on the go.

The invention includes the following interrelated objects, aspects and features:

(1) A top nipple cap cover in the shape of a nipple with a generally circular base, a snap fitting and a finger tab.

(2) A cylindrical tubular member having a top open end and a bottom open end having a flared portion (3) A nipple-shaped insert having a generally circular base is used to segregate clean and used nipples and collars.

(4) A bottom cover with a generally circular base and a snap fitting like that of the top cap cover.

(5) One or both of the top cap cover and the bottom cap cover also include a generally circular retaining ring attached by a flexible strip. The retaining ring slides over the cylindrical tubular member and keeps the cap from separating from the cylindrical tubular member.

BRIEF DESCRIPTION OF THE DRAWINGS

FIG. 1 illustrates a perspective view of the present invention.

FIG. 2 illustrates an exploded perspective view of the invention of FIG. 1.

FIG. 3 illustrates the invention of FIG. 1 with the top cap removed and the bottom cap in the open position.

DETAILED DESCRIPTION OF THE INVENTION

Figure 4:
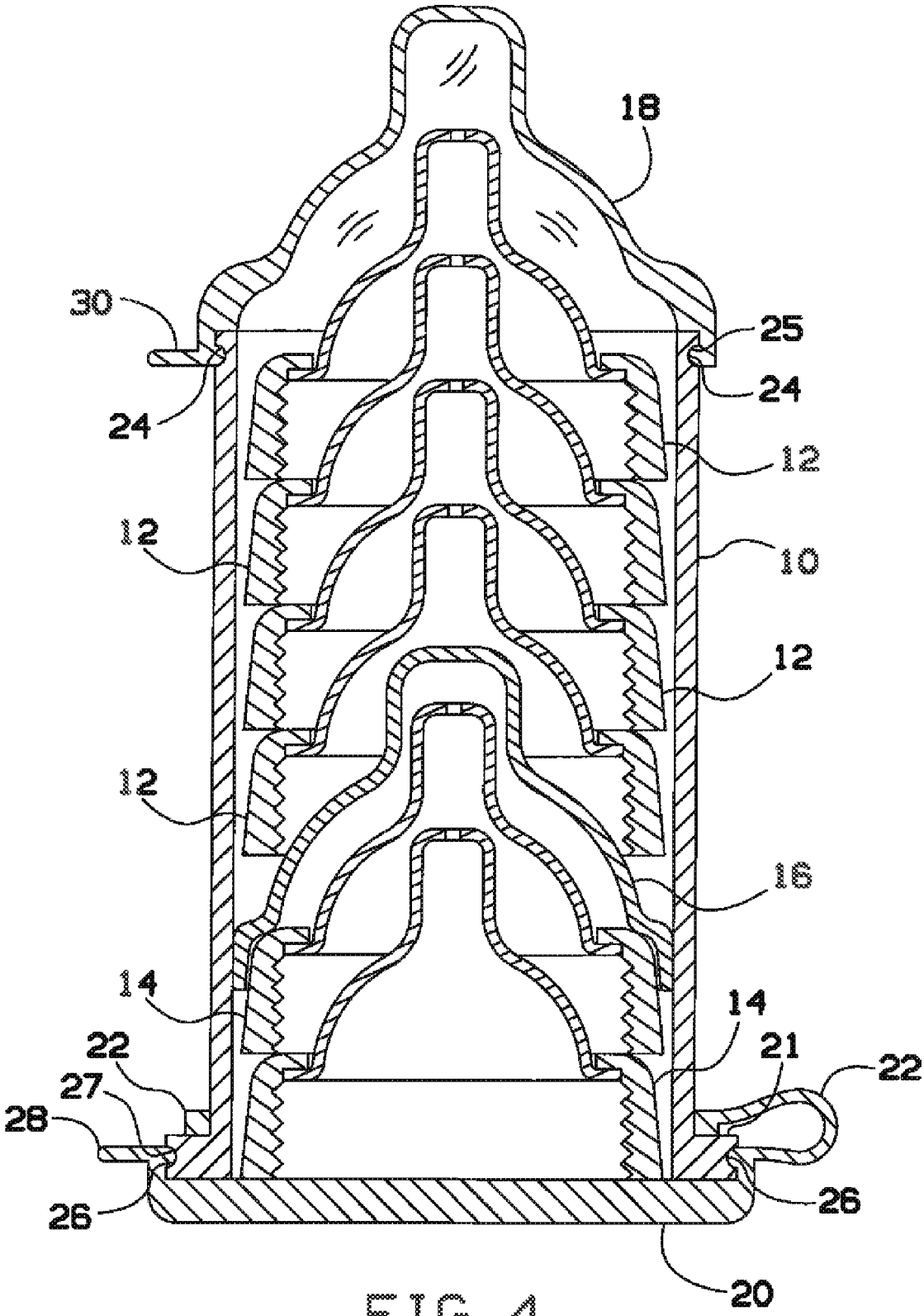
FIG. 4 illustrates a section view of the invention of FIG. 1.
Figure 5:
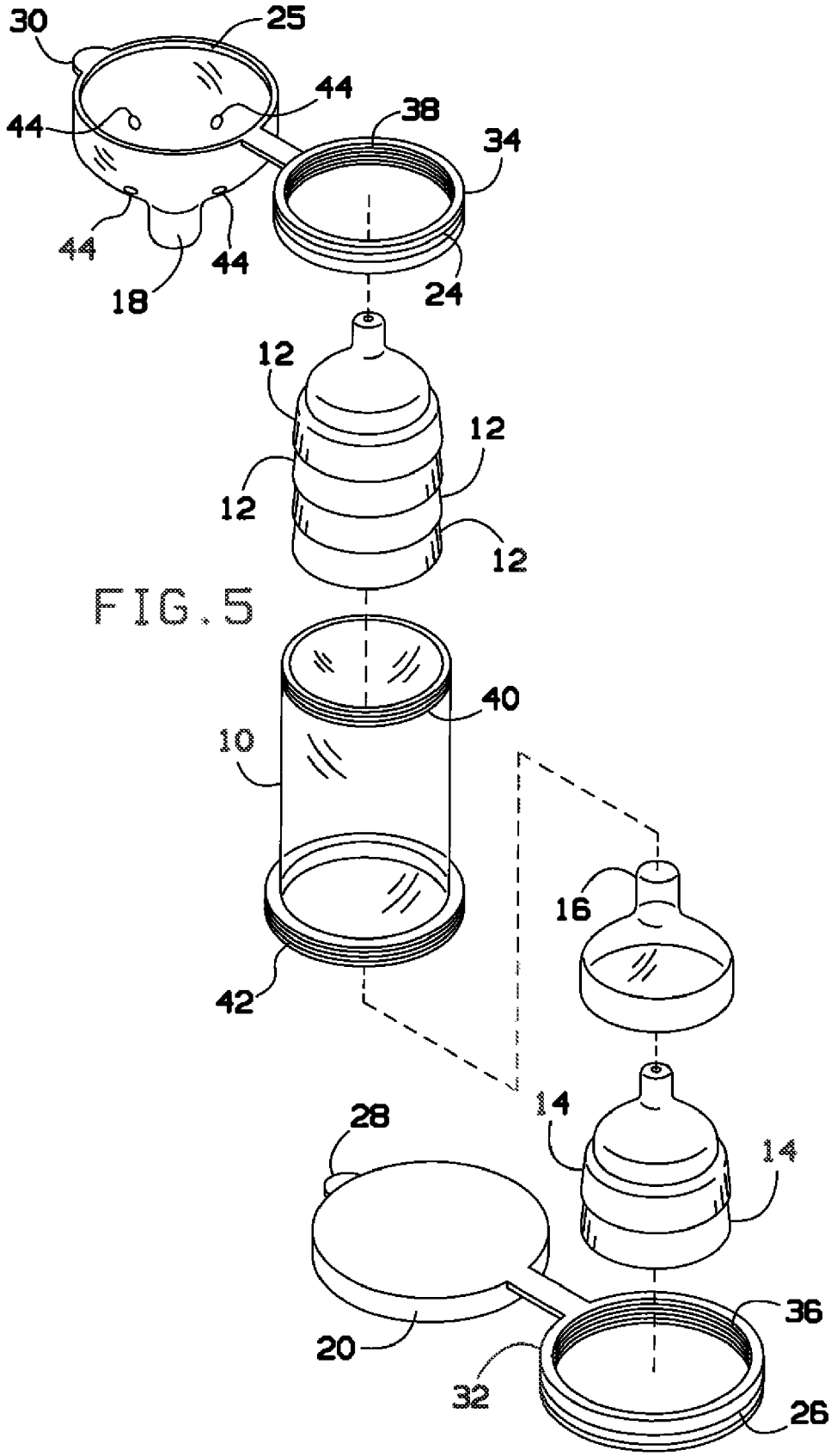
FIG. 5 illustrates an exploded perspective view of the invention according to an alternate embodiment.
Figure 6:
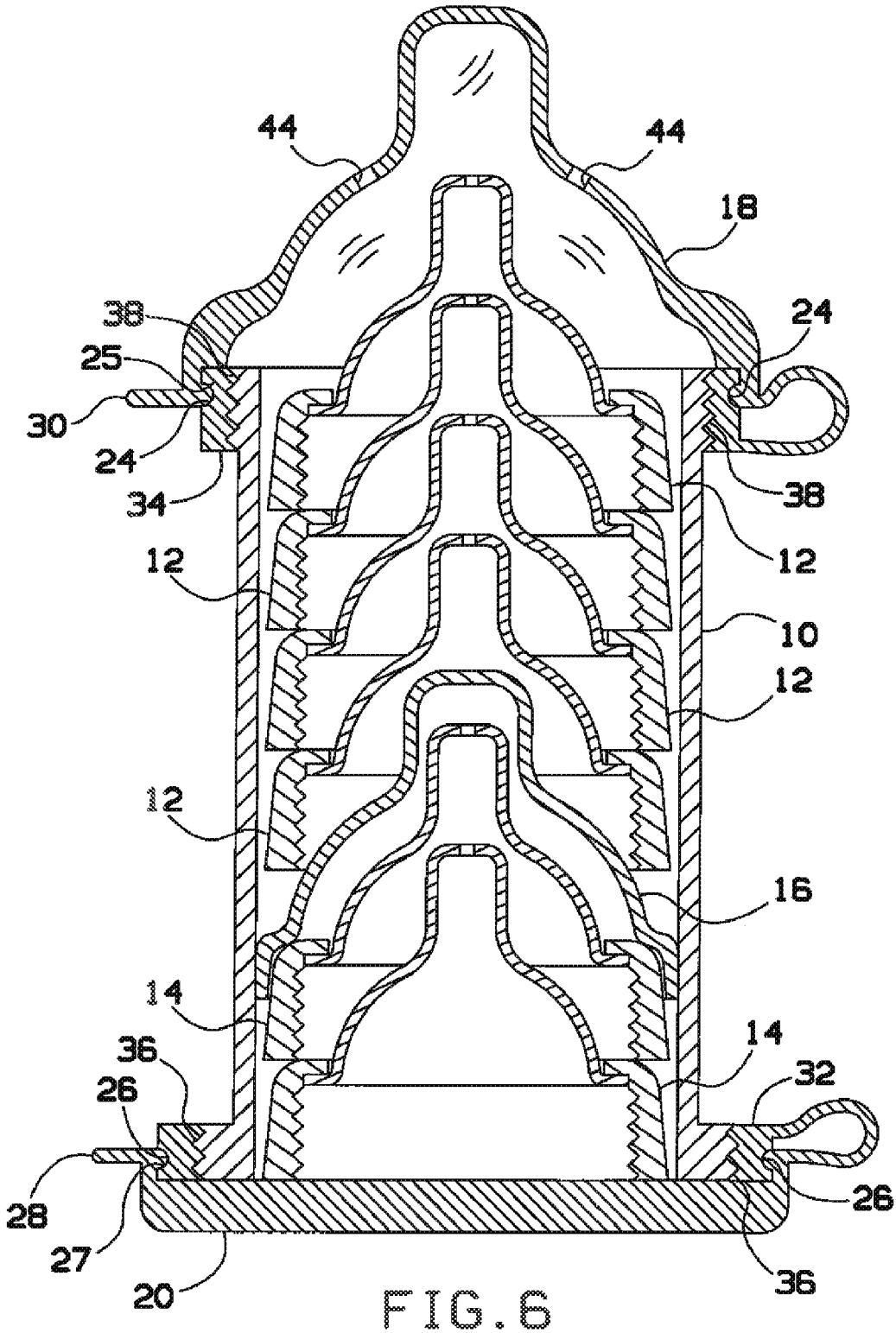
FIG. 6 illustrates a section view of the embodiment of FIG. 5.

The preferred embodiment of the device for storing both clean and used baby bottle nipples is depicted in FIGS. 5 and 6 and comprises a cylindrical tubular member 10 having a first thread 40 near the open top end and a second thread 42 at the open bottom end. The cylindrical tubular member 10 is preferably of a transparent material to allow viewing of any baby bottle nipples and collars stored within the dispenser and is preferably approximately 5 inches in length with an approximate diameter of 2¾ inches. A flare at the bottom end of the cylindrical tubular member 10 adds approximately ⅛ inches the entire way around the perimeter such that the diameter is 3" at the bottom end.

A nipple-shaped top cap 18 has a first interior lip and a top retaining ring 34 tethered by attachment or integral formation of a thin flexible strip to an exterior surface of the top cap 18. The interior of the retaining ring 34 a thread 38 for engaging the first thread 40 of cylindrical tubular member 10 to attach the top retaining ring 34 and thereby also attach the top cap 18 to the cylindrical tubular member 10 to prevent separation of the two and potential loss of top cap 18. The exterior of the top retaining ring 34 includes a groove 24 for receiving the interior lip of the top cap 18 to removably connect said top cap 18 to said retaining ring 34 and thereby said cylindrical tubular member 10. First interior lip is capable of engaging said groove 24 to close said first open end with said top cap 18. Nipple-shaped top cap 18 has a diameter corresponding to the top open end of the cylindrical tubular member 10 allowing for secure engagement of the two elements.

A nipple-shaped divider insert has a shape conducive to allowing said insert to be slidably contained within said cylindrical tubular member 10 while segregating the interior of the cylindrical tubular member into clean and used portions for respectively receiving clean and used nipples and collars. In this way contamination which may be present on used nipples or collars in the cylindrical tubular member will not be spread to any clean nipples or collars. The shape and approximate height of 2¼ inches permits relatively close engagement with used nipples and collars on one side and clean nipples and collars on the other.

A bottom cap 20 has a second interior lip and a bottom retaining ring 32 tethered to an exterior surface of said bottom cap 20. The interior of the retaining ring 32 has a second internal thread 36 for engaging the second thread 42 of cylindrical tubular member 10 to attach the bottom retaining ring 32 and thereby the bottom cap 20 to the cylindrical tubular member 10 to prevent loss. The exterior of the bottom retaining ring 32 also includes a groove 26 for receiving the interior lip of the top cap 18 to removably connect said bottom cap 20 to said cylindrical tubular member 10. Bottom cap 20 has a diameter corresponding to the flare at the bottom open end of the cylindrical tubular member 10 allowing for secure engagement of the two elements.

Tabs 28 and 30 are provided on the top 18 and bottom 20 caps to act as levers for facilitating removal of the nipple-shaped top 18 and bottom 20 caps from engagement with said cylindrical tubular member 10.

Another feature of this preferred embodiment is perforations 44 formed in top cap 18 to allow for communication of air inside the cylindrical tubular member 10 with outside air. In still further embodiments, perforations may be provided in the cylindrical tubular member 10 or the bottom cap 20.

As depicted in FIGS. 1-4, an alternative embodiment of a device for storing used and dispensing clean baby bottle nipples comprises a cylindrical tubular member 10 having a groove 24 at its open top end and a second groove 26 at its open bottom end distal from said top end. The cylindrical tubular member 10 is preferably of a transparent material to allow viewing of any baby bottle nipples and collars stored within the dispenser and is preferably approximately 5 inches in length with an approximate diameter of 2¾ inches. A flare at the bottom end of the cylindrical tubular member 10 adds approximately ⅛ inches the entire way und the perimeter such that the diameter is 3" at the bottom end.

A nipple-shaped top cap 18 has a first lip for engaging the first groove 24 of the cylindrical tubular member 10 to assemble said top cap 18 to the cylindrical tubular member 10 to close its open top end. Nipple-shaped top cap 18 has a diameter corresponding to the top open end of the cylindrical tubular member 10 allowing for secure engagement of the two elements. Nipple-shaped top cap 18 has an interior diameter corresponding to the top open end of the cylindrical tubular member 10 allowing for secure engagement of the two elements.

A nipple-shaped divider insert is of a size and shape conducive to allowing said insert to be slidably contained within said cylindrical tubular member 10. Nipple-shaped divider insert has a diameter slightly less than that of the cylindrical tubular member to allow for unrestricted sliding of the divider insert therein. The shape and approximate height of 2¼ inches permits relatively close engagement with used nipples and collars on one side and clean nipples and collars on the other.

A bottom cap 20 has a second lip for engaging the second groove 26 of the cylindrical tubular member 10 to assemble the bottom cap 20 to cylindrical tubular member 10 to close its open bottom end. Bottom cap 20 has a diameter corresponding to the flare at the bottom open end of the cylindrical tubular member 10 allowing for secure engagement of the two elements.

Retaining ring 22 is tethered to the bottom cap 20 and when slid over the cylindrical tubular member 10 at the top end holds bottom cap 20 to cylindrical tubular member 10 to prevent separation of the two and potential loss of bottom cap 20. Retaining ring 22 is prevented from slipping off of cylindrical tubular member 10 by the top cap 18 at the top end and by a flare 21 at the bottom end.

Tab 28 is formed on an edge of said bottom cap 20 and capable of acting as a lever for facilitating removal of said bottom cap 20 from engagement with said cylindrical tubular member 10. A second tab 30 is also formed on an edge of said top cap 18 and capable of acting as a lever for facilitating removal of said top cap 18 from engagement with said cylindrical tubular member 10.

How To Use The Invention:

A user removes the used nipple and collar from a feeding bottle (not shown), opens the dispenser by removing the bottom cap 20 which remains tethered to the cylindrical tubular member by way of the bottom retaining ring. After placing the used nipple cap 14 into the tubular cylindrical member through the bottom opening, the user replaces the bottom cap by snapping the interior lip of the bottom cap into the groove of bottom retaining ring 32. The dispenser is thereby closed at its bottom end and the used nipple and collar 14 is separated from clean nipples and collars 12 by nipple-shaped insert 16.

The user may now open top end of the cylindrical tubular member 10 by removing the top cap 18 which remains tethered to the cylindrical tubular member 10 by way of the top retaining ring 34. It is now possible to remove a clean nipple and collar 12 from the cylindrical tubular member 10 and subsequently replace the top cap 18 by snapping engagement of interior lip of the top cap 18 into the groove of the top retaining ring 34.

The clean nipple and collar 12 may now be placed onto the feeding bottle and the infant or toddler may be safely fed. The dispenser is capable of being stowed in a bag or backpack while occupying approximately the same amount of space as a feeding bottle.

Preferably, all of the components of the storage dispenser would be made of high grade plastic and would be formed via a press that would mold each component separately. Components would subsequently be assembled by machine or by hand. It may be desirable to offer gender-preferred transparent colors of cylindrical tubular member.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

I claim:

1. A device for storing both clean and used baby bottle nipples and collars comprising:

a cylindrical tubular member having a first attachment mechanism at a first open end and a second attachment mechanism at a second open end distal from said first end;

a nipple-shaped top cap having a first engagement element for assembling said top cap to said first attachment mechanism;

a nipple-shaped divider insert having a size and shape conducive to allowing said insert to be slidably contained within said cylindrical tubular member;

a bottom cap having a second engagement element for assembling said bottom cap to said second attachment mechanism to close the second open end of the cylindrical tubular member; and a retaining ring tethered to said bottom cap and capable of engaging an exterior surface of said cylindrical tubular member such that when said bottom cap is not assembled to said cylindrical tubular member via interaction of said second engagement element with said second attachment mechanism, said bottom cap may be held to said cylindrical tubular member by said retaining ring.

2. The device of claim 1, further comprising:

a tab formed on an edge of said nipple-shaped top cap and capable of acting as a lever for facilitating removal of said nipple-shaped top cap from engagement with said cylindrical tubular member.

3. The device of claim 1, further comprising:

a tab formed on an edge of said bottom cap and capable of acting as a lever for facilitating removal of said bottom cap from engagement with said cylindrical tubular member.

4. The device of claim 1, wherein said first attachment mechanism is a first groove and said first engagement element is a first lip.

5. The device of claim 1, wherein said second attachment mechanism is a second groove and said second engagement element is a second lip.

6. A device for storing both clean and used baby bottle nipples and collars comprising:

a cylindrical tubular member having a first attachment mechanism at a first open end and a second attachment mechanism at a second open end distal from said first end;

a nipple-shaped top cap having an first interior lip;

a top retaining ring tethered to said top cap;

a groove on an exterior surface of said top retaining ring;

a first engagement element on an interior surface of said top retaining ring;

whereby said first engagement element is capable of engaging the first attachment mechanism to removably connect said top cap to said cylindrical tubular member and wherein said first interior lip is capable of engaging said groove to close said first open end with said top cap;

a nipple-shaped divider insert having a shape conducive to allowing said insert to be slidably contained within said cylindrical tubular member;

a bottom cap having a second interior lip; and a bottom retaining ring tethered to said bottom cap;

a second groove on an exterior surface of said bottom retaining ring;

a second engagement element on an interior surface of said bottom retaining ring; and whereby said second engagement element is capable of engaging the second attachment mechanism to removably connect said bottom cap to said cylindrical tubular member and wherein said second interior lip is capable of engaging said second groove to close said second open end with said bottom cap.

7. The device of claim 6, further comprising:

a tab formed on an edge of said nipple-shaped top cap and capable of acting as a lever for facilitating removal of said nipple-shaped top cap from engagement with said cylindrical tubular member.

8. The device of claim 6, further comprising:

a tab formed on an edge of said bottom cap and capable of acting as a lever for facilitating removal of said bottom cap from engagement with said cylindrical tubular member.

9. The device of claim 6, further comprising:

a plurality of perforations in said top cap.

10. The device of claim 9, further comprising:

a first tab formed on an edge of said top cap and capable of acting as a lever for facilitating removal of said top cap from engagement with said top retaining ring; and a second tab formed on an edge of said bottom cap and capable of acting as a lever for facilitating removal of said bottom cap from engagement with said bottom retaining ring.

* * * * *